United States Patent [19]

Arhippainen et al.

[11] 4,042,452

[45] Aug. 16, 1977

[54] PROCESS FOR WASHING CELLULOSE PULP FROM ALKALI DIGESTION WHEREIN ACID IS ADDED TO THE WASHING SOLUTION

[75] Inventors: Bengt Arhippainen; Johan Gullichsen, both of Helsinki, Finland

[73] Assignee: A. Ahlstrom Osakeyhtio, Finland

[21] Appl. No.: 608,034

[22] Filed: Aug. 27, 1975

[30] Foreign Application Priority Data

Sept. 3, 1974 Finland ..... 742578

[51] Int. Cl.[2] ..... D21C 9/02

[52] U.S. Cl. ..... 162/60; 162/76; 162/83; 162/87; 162/89

[58] Field of Search ..... 162/60, 87, 81, 83, 162/82, 76, 88, 89, 64, 67, 66; 8/156

[56] References Cited

U.S. PATENT DOCUMENTS

| | | | |
|---|---|---|---|
| 1,683,262 | 9/1928 | Richter et al. | 162/60 |
| 1,798,987 | 3/1931 | Rue | 162/87 X |
| 2,745,712 | 5/1956 | Burling et al. | 8/156 |
| 3,308,012 | 3/1967 | Tobar | 162/76 X |
| 3,698,995 | 10/1972 | Rapson | 162/82 X |
| 3,829,357 | 8/1974 | Thompson et al. | 162/89 |
| 3,919,041 | 11/1975 | Wilder | 162/89 |

*Primary Examiner*—S. Leon Bashore
*Assistant Examiner*—M. Steven Alvo
*Attorney, Agent, or Firm*—Bucknam and Archer

[57] ABSTRACT

A process for washing a cellulose pulp from alkali digestion, wherein the pulp is fed into a multistage washing system comprising several countercurrently coupled washers, acid is added to a washing solution, the acidified fiber suspension is fed further to the following stage wherein the acidified solution is replaced in the fiber suspension by washing water, and the filtrate obtained from this stage is used after acidification at least partially as a washing solution at the previous stage. The acid is added at a stage when the concentration of the dissolved organic substances is at a value that detrimental precipitation of the organic substances is prevented.

4 Claims, 3 Drawing Figures

PROCESS FOR WASHING CELLULOSE PULP FROM ALKALI DIGESTION WHEREIN ACID IS ADDED TO THE WASHING SOLUTION

BACKGROUND OF THE INVENTION

The present invention relates to a process for washing a cellulose pulp from alkali digestion.

The washing of a cellulose pulp from alkali digestion is usually performed with water or process condensates in a system consisting of countercurrently coupled washers. Part of the wash losses, i.e., that part of the inorganic and dissolved organic material which remains in the fibrous material after the wash remains chemically combined, absorbed or enclosed in the fibrous material so that it cannot be removed with water. By lowering the pH value of the washing solution by an acid addition that part which cannot be removed with water can be released. It has, however, been suggested that certain detrimental effects are thereby produced. Dissolved lignin or other organic substance precipitates when the pH value is lowered, and if the fibers have been treated by sulfate, polysulfide or hydrogen sulfide digestion, hydrogen sulfide gas is released under the effect of a reaction between the acid and the sulfides of the spent liquor. An acid wash is applied when the object is to separate trace elemets, such as heavy metals which have been noted to catalyze the decomposition of cellulose in so-called oxygen bleaching or delignification. This stage is placed separately between the wash and the subsequent oxygen gas treatment. The filtrate from this treatment is fed directly into the sewage system.

The general trend in the cellulose industry is to decrease liquid and gaseous wastes by closing liquid circulation systems in the process. This means that contamination increases in the circulation system, which can be compensated for on the liquid side by adopting several countercurrently coupled washing stages. This, however, considerably increases production costs.

SUMMARY OF THE INVENTION

The present invention relates to a system wherein the total washing efficiency is increased by chemical means, mainly by lowering the pH value in one or several liquid cycles of the washing system. In addition to increased efficiency, a number of substantial advantages are thereby gained:

If the pH of the spent liquor is lowered, its color becomes considerably lighter. This factor can be utilized, for example, in mills which have a screen open on the liquid side, in which case the color of the spent liquor is of substantial importance as an environmental factor.

Foaming in the screen room is a problem in all alkali-based cellulose processes. Foaming is considerably reduced when the pH value is lowered.

An acid wash considerably increases the brightness of the fibers, especially if an oxidizing acid is selected. This effect can be utilized in the production of unbleached products wherein the color of the fibers and the brightness are, however, of importance.

A conventional bleaching is started with acid chlorine or with a chlorine dioxide stage. At this stage a significant part of the bleaching agent is consumed for the neutralization of the alkaline fiber suspension, and this portion will portionally increase when closing the liquid circuits in the washing and screen sections prior to the bleaching. By oxidizing the liquid in the circulation system of the washing plant the consumption of expensive bleaching chemicals for the neutralization can thus be reduced. According to a preferred embodiment of the invention, the acid which is added to the washing solution is an oxidizing acid or an acid additionally containing an oxidizing agent for the purpose of the combined oxidation of the cellulose.

If an oxidizing acid is used, such as a sulfur dioxide solution, sulfurous acid, mixtures of chlorine dioxide and sulfuric acid, chlorine, etc., the sulfides, other reduced sulfur compounds, and possibly free hydrogen sulfide or mercaptan present in the spent liquor are oxidized into sulfites, sulfates, thiosulfates or elemental sulfur, while acidification only would release reduced sulfur as malodorous hydrogen sulfide gas.

The undesired detrimental precipitation effects can be prevented by performing the acidification at a stage wherein the concentration of dissolved substance is such that possible precipitation is without significance.

EXAMPLE 1

Figure 1:
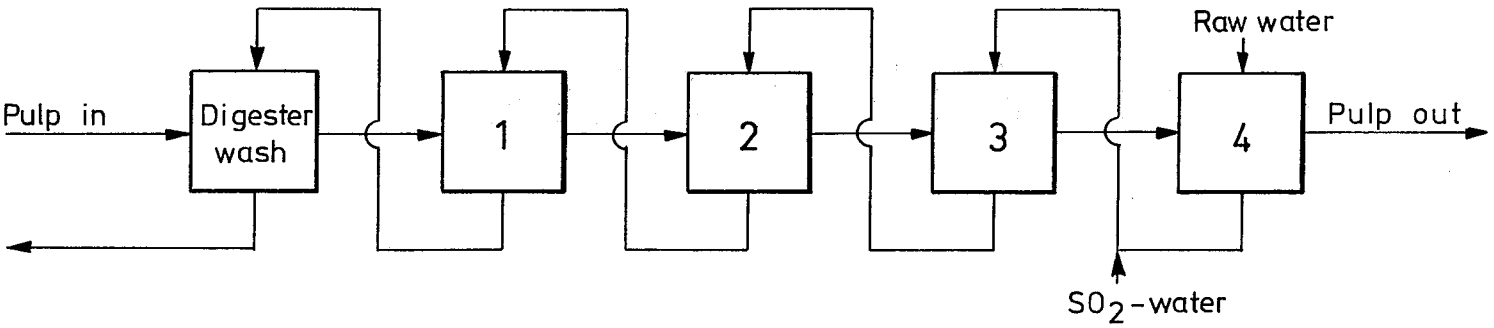
FIG. 1 is a schematic flow diagram of a five stage washing sequence of the present invention.

A trial on full industrial scale, in principle according to the system illustrated in FIG. 1, was performed with birch sulfate pulp which was washed in five separate countercurrently coupled stages comprising a 45-minute wash in a continuous digester and four diffuser stages placed in one and the same tower. The circulating liquid between stages 3 and 4 was acidified to pH 3 by means of a sulfur dioxide solution. The result was compared with the result obtained without sulfur dioxide acidification. The result, which is given in the enclosed table, clearly shows that the total wash losses expressed as sodium sulfate/one ton air-dry pulp decreased to 40%, the brightness of the pulp increased by 5 SCAN units, and the replacement efficiency increased considerably at all diffuser stages, the consumption of sulfur dioxide being 6.5 kg/one ton air-dry pulp.

| | Without $SO_2$ | With $SO_2$ |
|---|---|---|
| pH value of liquid: | | |
| to stage 1 | 11 | 7.8 |
| 2 | 10.7 | 6.6 |
| 3 | 10.5 | 2.9 |
| 4 | 7.0 | 7.0 |
| outlet pulp | | |
| - pH | 10 | 5.1 |
| brightness % SCAN | 33.6 | 38.7 |
| - wash loss, total Na kg $Na_2SO_4$/ton | 8.8 | 3.6 |
| - wash loss, $Na_2SO_4$ to be washed/ton | 3.3 | 3.0 |
| - replacement efficiency E | | |
| stage 1 | 5.3 | 6.5 |
| 2 | 2.8 | 3.8 |
| 3 | 1.8 | 2.6 |
| 4 | 1.4 | 1.9 |

EXAMPLE 2

Figure 2:
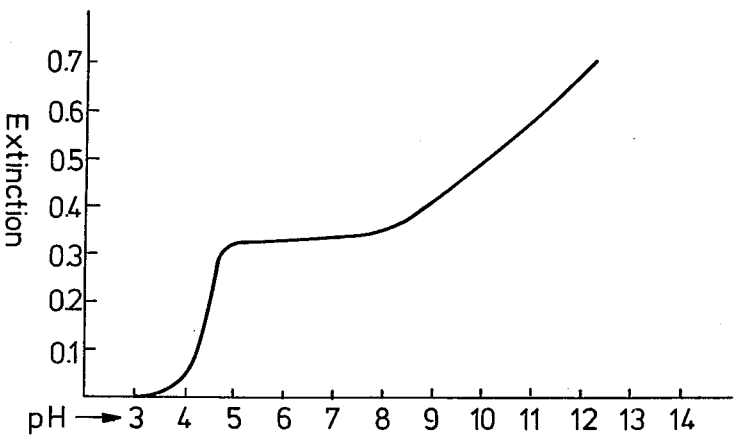
FIG. 2 is a graph showing how the color of the spent liquor is dependent on its pH.

A pine sulfate spent liquor was acidified with a sulfur dioxide solution, and the extinction of the liquor was measured with a blue filter at wavelength 415 nm. The result given in FIG. 2 clearly indicates how strongly the color of the spent liquor is dependent on its pH value.

Figure 3:
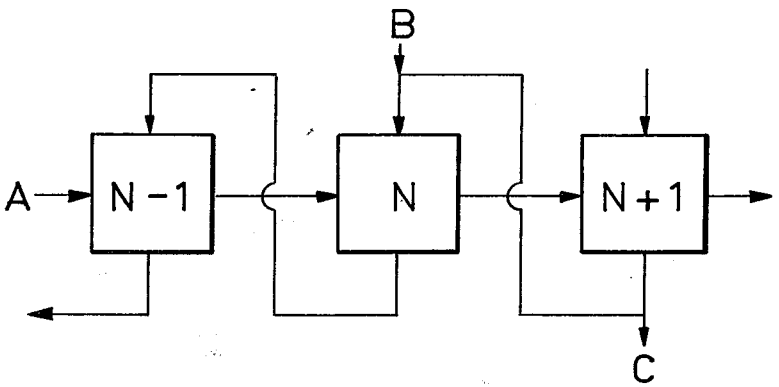
FIG. 3 is a schematic flow diagram of the present invention.

The present invention can be described (FIG. 3) as a system wherein suspension A, which consists of fibers and the spent liquor from an alkaline cook is fed through a multistage system of countercurrently coupled washers. The displacing liquid to stage N, which corresponds to the filtrate of stage N+1, is acidified to a suitable pH value by means of acid B, which can advantageously be some oxidizing substance, e.g., a sulfur dioxide solution, a mixture of chlorine dioxide and sulfuric acid, chlorine, etc. The fiber suspension thus acidified is further fed to stage N+1, where the acid liquid is displaced from the fiber suspension by washing water which can be either so called raw industrial water or acid, neutral or alkaline circulating water from some later treatment stage of the production process. The filtrate obtained from stage N+1 is used entirely or partially as a washing solution at stage N after an acidification performed by means of acid B. In case it is desirable especially to remove from the washing system the separated components, such as the trace elements undesirable in the later process, part C of the liquid from stage N+1 can be fed to another part of the production process, preferably the chemicals regeneration section and be used there as a diluent or washing solution.

The acidification can be performed even below pH 3, and the location of the acidification in the washing system can be selected at a point where the dissolved dry matter content in the fiber suspension entering the washing stage is equivalent to a sodium sulfate amount up to 250 kg/one ton pulp. The washing devices used can be filters, diffusers, etc.

What is claimed is:

1. A process for washing a cellulose pulp from alkali digestion, prior to the bleaching stage wherein the pulp is fed into a multistage washing system comprising at least three countercurrently coupled washers/in sequence, acid is added directly to a washing solution thus lowering the pH of said solution to a value of 3 or lower at a stage immediately preceding the last washing stage when the concentration of dissolved organic substances is at a value that detrimental precipitation of the organic substances is prevented, the acidified fiber suspension is fed further to the last stage wherein the acidified solution is displaced from the fiber suspension by washing water, and the solution obtained form the last stage is used at least partially as a washing solution at the said stage immediately preceding the last stage.

2. The process of claim 1, in which the stage immediately preceding said last washing stage has the fiber suspension fed with a dissolved substance content equivalent to 250 kg sodium sulfate per one ton of pulp.

3. The process of claim 1, in which the acid which is added to the washing solution is an oxidizing agent.

4. The process according to claim 1, in which in addition to acid, some oxidizing agent is added to the washing solution for the purpose of the combined oxidation of the cellulose pulp and the spent liquor.

* * * * *